US005868621A

United States Patent [19]

Parsons

[11] Patent Number: 5,868,621

[45] **Date of Patent: *Feb. 9, 1999**

[54] EXPANDABLE BATON WITH OFFSET TAPERED LOCKING ZONE AND METHOD OF MAKING SAME

[75] Inventor: Kevin L. Parsons, Appleton, Wis.

[73] Assignee: Armament Systems & Procedures, Inc., Appleton, Wis.

[ * ] Notice: The term of this patent shall not extend beyond the expiration date of Pat. No. 5,657,986.

[21] Appl. No.: 782,877

[22] Filed: Jan. 14, 1997

Related U.S. Application Data

[63] Continuation of Ser. No. 313,008, Sep. 27, 1994, Pat. No. 5,657,986.

[51] Int. Cl.[6] ..... F41B 15/02

[52] U.S. Cl. ..... 463/47.7; 135/75; 403/109; 285/302

[58] Field of Search ..... 463/47.2, 47.5, 463/47.6, 47.7; 403/109, 377; 135/75; 285/302

[56] References Cited

U.S. PATENT DOCUMENTS

| | | | |
|---|---|---|---|
| 2,757,002 | 7/1956 | Ryden | 463/47.7 |
| 4,037,839 | 7/1977 | Nelson | 463/47.7 |
| 4,657,986 | 4/1987 | Parsons | 463/47.7 |

*Primary Examiner*—William M. Pierce
*Attorney, Agent, or Firm*—McDonnell Boehnen Hulbert & Berghoff

[57] ABSTRACT

An expandable baton includes a plurality of sections adapted to be stowed in a nested, collapsed position. The sections may be opened by swinging the baton in a whipping action into a locked extended position. Each of these sections may be made of similar or dissimilar materials, with the tip section having at least a portion being made of a relatively high mass material to preserve strike force when used in a whipping motion and at least one other section being made of a lightweight material to reduce weight of the overall baton. The lightweight section includes lock zones of increased thickness for enhancing the strength and durability of the lightweight section and preserving the overall strength and durability of the assembled baton. The increased material in the lock zones permits the lock zones to be of a greater functional length than prior art single thickness baton sections.

8 Claims, 2 Drawing Sheets

EXPANDABLE BATON WITH OFFSET TAPERED LOCKING ZONE AND METHOD OF MAKING SAME

This application is a continuation of prior application Ser. No. 08/313,008 filed on Sep. 27, 1994, now U.S. Pat. No. 5,637,986.

BACKGROUND OF INVENTION

1. Field of Invention

The subject invention is generally related to nightsticks, batons and intermediate impact weapons and is specifically directed to an expandable baton for use by law enforcement personnel, and the method of making same.

2. Description of the Prior Art

Nightsticks and batons are well known and have gained widespread acceptance as intermediate force weapons for use by law enforcement personnel. One of the best known of these weapons is the ASP Expandable Baton manufactured by Armament Systems and Procedures, the assignee of the subject application, and disclosed in U.S. Pat. Nos. 5,110,375, 5,149,092, and 5,348,297. Typically, the ASP Baton includes three telescoping sections, the outer, largest section defining a handle adapted for receiving and nesting the remaining sections when the baton is in a collapsed position. In this position, the baton is approximately 8 to 10 inches long and can be carried by law enforcement personnel in a suitable sheath or scabbard on the belt of the uniform. The baton is adapted to be drawn quickly from the sheath and opened in a swinging action for whipping the nested sections out to an extended position and locking them in position for use as an intermediate force weapon.

Over the years, it has been determined that the expandable batons required for use by law enforcement personnel must be of sufficient strength and durability to eliminate the sections from separating and "flying apart" when the baton is whipped open, particularly after repeated uses. In addition, it has been found that the deadlock taper joint for frictionally locking the telescoping sections in the extended position must be of a sufficient hardness to assure good friction without extensive deformation, extending the life of the baton while at the same time eliminating the tendency of the baton to bend or crack at the various joints. The ASP Baton was the first baton to address many of these issues and utilizes a hardened, heat treated steel alloy for assuring proper function and durability, as required by law enforcement personnel.

While the ASP Baton has greatly advanced the art relating to intermediate force weapons, its major drawback is the additional weight the baton adds to the standard issue equipment a law enforcement officer must carry on his person while on duty. Typically, law enforcement personnel carry portable two-way radios, firearms, ammunition, handcuffs, chemical irritants, and flashlights in addition to the intermediate force baton. When all of this equipment is positioned on the belt of the officer or elsewhere on his uniform, it adds substantially to the weight of the uniform and at times can become quite cumbersome. In an effort to reduce the weight requirements there has been a continuing move toward lighter weight equipment without sacrificing function. For example, many uniforms now have nylon issue belts rather than leather, the two-way radios have routinely become smaller and lighter in weight with the continuing development of solid state electronics. New battery sources and high intensity lamps have permitted flashlights to become smaller and lighter in weight. Side arms have continually gotten smaller and lighter in weight and are made of more exotic, lighter weight materials than their predecessors. Therefore, it is desirable to provide an intermediate force weapon which also contributes to the efforts to reduce the weight of equipment carried by law enforcement personnel.

While the ASP Baton continues to meet and exceed the functional requirements of law enforcement agencies, it would be desirable to reconfigure the baton to provide a reduction in weight without a loss of function. Several attempts have been undertaken to resolve this problem. For example, a functional baton can be made out of a lightweight material such as aluminum. However, the lightweight material, while properly locking and resisting bending has not proven successful, even with its dramatic weight advantage, because of the drop in striking force particularly when used in a swinging fashion.

When a law enforcement officer attempts to restrain an individual through a swinging action, the amount of force associated with the swing is attributable to the centrifugal force generated at the tip of the baton. Thus, the greater the weight of the baton and the longer the baton, the greater the tip swinging force. Expandable batons, permitting a 9 inch stowed weapon to be expanded to approximately 26 inches, have greatly increased the length of the weapons usable by the law enforcement officer and have permitted a dramatic increase in the inertia provided by the weapon when used in a swinging fashion. In addition, the steel weight has also contributed greatly to the swinging force generated by the weapon. By substituting a lightweight material such as aluminum for the baton, the second factor of the equation has been reduced, resulting in a lower impact force generated by the swinging action.

More recently, ASP has introduced a lightweight expandable baton wherein the various sections of the baton are made of dissimilar materials, permitting the baton to be lighter in weight while at the same time maintaining the durability and strike force capability of the heavier steel baton. This baton is shown and described in my U.S. Pat. No. 5,356,139. The baton there shown recognizes that the strike force is primarily created by the centrifugal force generated by the mass at the tip of the baton. Therefore, the handle section and/or the intermediate sections can be made of a lightweight material without greatly altering the impact force of the baton as long as the outer mass of the baton is maintained. While this baton has greatly improved the functionality of lightweight weapons, there is some reduction in the locking force and strength of the baton due to the use of lighter weight, lower strength materials such as aluminum. While it is possible to overcome this minor disadvantage by using more exotic light weight materials, the cost disadvantages make such solutions prohibitive.

Therefore, there remains a need for a lightweight, expandable, intermediate force baton for use by law enforcement personnel which maintains the strike force capability of prior art batons while at the same time greatly reducing the weight of the weapon, wherein the joint strength is not sacrificed and the overall costs of the weapon are competitive with prior art batons. or art batons.

SUMMARY OF THE INVENTION

The subject invention is directed to a light weight expandable baton with at least the intermediate section being made of a light weight material such as aluminum, wherein the tip section of the baton is a hardened steel material which has the same mass and function as the tip section of prior art batons. In addition the light weight sections are configured in such a manner to maintain the joint durability and strength formerly only achieved in all hardened steel batons. By placing the heavy mass at the outer tip end of the baton, the strike force capability of the baton is maintained virtually unchanged from the heavier prior art batons. The light weight section is both formed and machined to provide for thick wall sections in the joint regions without increasing the overall diameter of the section, thereby maintaining the desired profile and dimensions of the accepted prior art batons.

In the preferred embodiment, the light weight section is constructed from a cylindrical tube, preferably of aluminum, the tube having an initial wall thickness which is greater than the desired final dimension. The outer end of the tubular section is swaged to form a reducing taper. The remainder of the section is then machined to reduce the general wall thickness to the standard thickness. The opposite end of the section may be machined into a flaring, enlarging taper, thereby providing a thickened wall section out the opposite joint end as well. In addition, by taking advantage of the additional material available by using a thicker walled tube, the engagement region of the deadlock taper zone is enlarged, extending the life of the baton and further increasing the strength of the joints. The deadlock taper is more clearly described in my aforementioned issued U.S. Pat. Nos. 5,110,375, 5,348,297, and 5,356,139 incorporated herein by reference.

The typical intermediate force baton made in accordance with the subject invention weighs approximately eleven ounces. This contrasts with the typical all steel baton which weighs approximately 20 ounces. This significant weight advantage has an impact on the adaptability and acceptability of the baton by law enforcement personnel. By reducing the weight of the baton, coupled with the reduction in weight of the other equipment carried by the officer, the fatigue factor on the officer is reduced and, in addition, additional equipment can be carried without an overall increase in weight requirements. The lightweight expandable baton of the subject invention provides an improved intermediate force baton combining the lightweight materials in the handle and/or center sections with a high mass tip section to gain a weight advantage while retaining the desirable impact and durability features of a heavier mass baton at the strike force area.

Therefore, it is an object and feature of the subject invention to provide a baton of lighter weight than an all steel baton without noticeable loss of strike force capability and with a joint strength substantially equal to the joint strength of all hardened steel batons.

It is also an object and feature of the subject invention to provide a baton utilizing a high mass at the strike force area while utilizing a lightweight material in the handle and/or intermediate area.

It is a further object and feature of the subject invention to provide an expandable lightweight baton wherein the various sections of the baton are made of dissimilar materials having different specific weights and different hardnesses, while preserving the joint strength and durability of single material hardened steel batons.

Other objects and features will be readily apparent from the accompanying drawings and description.

BRIEF DESCRIPTION OF THE DRAWINGS

FIG. 1 is a longitudinal sectional view of the prior art expanded batons and FIG. 7 is a enlarged fragmentary view of a joint section of the baton.

DETAILED DESCRIPTION OF THE DRAWINGS

Figure 9:
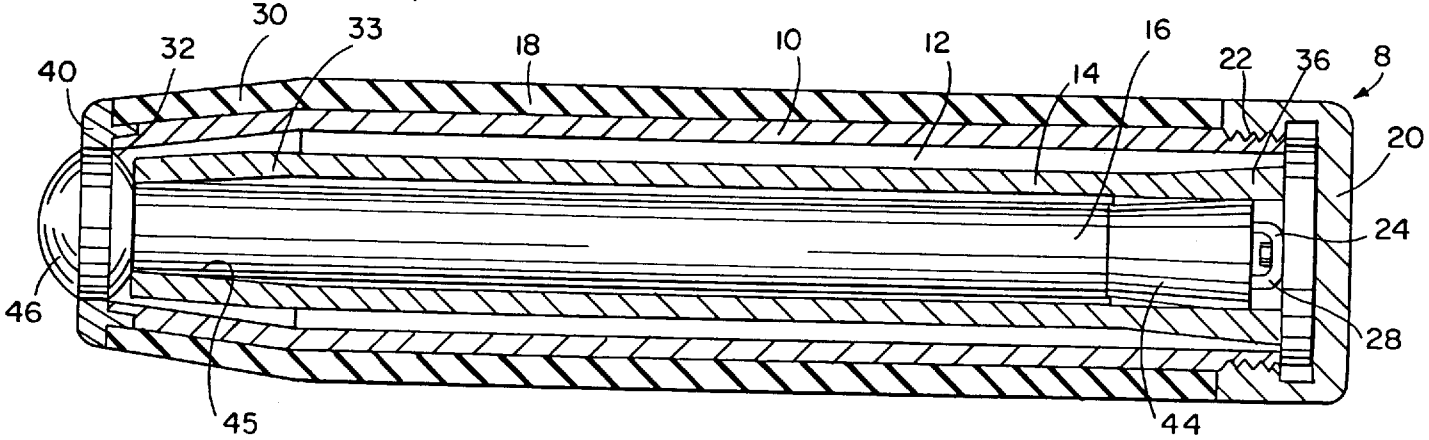
FIG. 9 is a longitudinal cross-sectional view of a baton made in accordance with the subject invention as in the nested, stowable condition.

Turning first to FIG. 9, the baton 8 of the subject invention generally comprises an outer generally substantially cylindrical section 10 having an interior open cavity 12 adapted for receiving the remaining sections 14 and 16 of the baton for stowing them in nested fashion. In the preferred embodiment, a resilient sleeve or cover 18 is positioned over the outer section 10 for providing a resilient, non-slip handle by which the baton may be grasped during use. Typically, the baton section 10 includes a closure cap 20 at one end thereof for closing the open end. In the preferred embodiment, the cap 20 is adapted to fit over the perimeter of the outer section 10, and is threadably received thereon, as at 22 for tightening the cap about and closing the open end. In assembly, the remaining nested sections 14 and 16 of the baton are placed in the cavity 12, after which the cap 20 is placed in position and tightened for retaining the sections therein. Also, in the preferred embodiment, a nesting lock system 24 is secured in the cap 20 and includes a dual leaf spring 28 or similar securing device adapted to be received in the hollow end of the tip section 16. The spring legs extend into the interior of the section 16 for engaging the inner peripheral wall to secure the baton for securing the baton in the collapsed position shown in FIG. 9. The preferred embodiment of the retainer clip is shown and described in my issued U.S. Pat. No. 5,161,800, incorporated by reference herein.

The opposite open end 30 of the outer section is tapered to define a reduced opening 32. The next adjacent baton section 14 is likewise tapered at 33. The cylindrical portion of the section 14 and the tapered portion 33 easily pass through the opening 32 of the outer section 10. The opposite end of the section 14 is flared as at 36.

In the preferred embodiment, and as disclosed in my issued U.S. Pat. No. 5,110,375 and incorporated herein by reference, the angle of taper at 30 and the angle of flare at 36 are set to define a deadlock taper when the section 14 is whipped to a fully extended position, wherein the flare 36 engages the taper 30 to lock the baton in the extended position. An end cap 40 may be provided and secured to the outer end of baton section 10 and includes an opening 42 suitable for passing the tapered portion 33 and the cylindrical portion of section 14, but not the flare 36, to permit the baton to be extended to the locked position.

In the preferred embodiment, the intermediate nested section 16 is housed in the hollow interior of section 14 and includes a increasing tapered end 44 which is adapted to engage the interior tapered wall 45 formed by the tapered end 33 of section 14. The taper 45 and flare 44 engage to define a taper lock, as previously described.

In the preferred embodiment, it is also desirable to provide an enlarged tip 46 which may be suitably secured to the outer end of the baton section 16. The extended tip section 16 of the baton is made of a heavy, hardened steel alloy to preserve the strike force created when using this baton in a swinging fashion by providing sufficient mass at the outer end of the baton to take advantage of the centrifugal force generated during a swinging or whipping action. However, to reduce the weight of the baton, the handle section 10 and/or the intermediate section 14 is made of a formable, machinable lightweight material such as aluminum or the like. Thus, the subject invention permits the baton to be of selective weights and masses by interchanging the material of the intermediate section while maintaining the outer tip section 16 of steel or other heavyweight, durable, hardened material.

Figure 2:
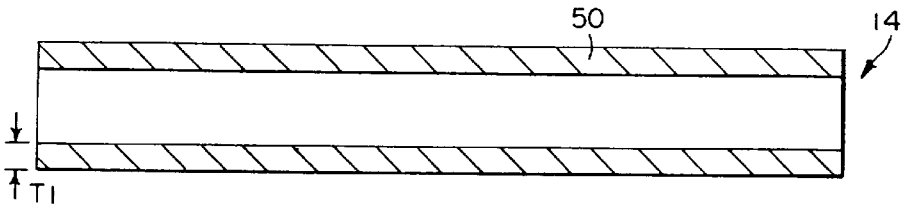
FIG. 2 is a longitudinal sectional view of the light weight tube section for use in a baton made in accordance with the teachings of the subject invention.
Figure 3:
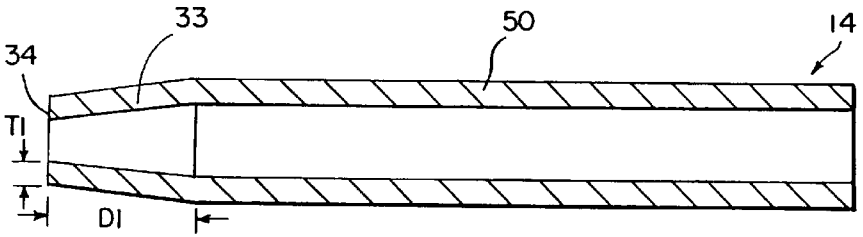
FIG. 3 shows the tube section of FIG. 2 after it has been formed to define a reducing taper lock zone on one end.
Figure 4:
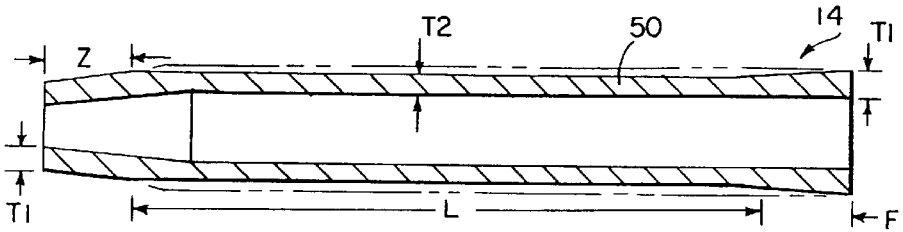
FIG. 4 is a view similar to FIG. 3, illustrating the tube section after it has been machined to define a baton section of standard wall thickness over its functional length intermediately of the end joint zones.
Figure 5:
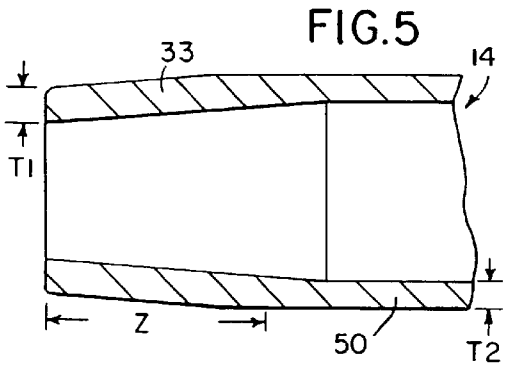
FIG. 5 is an enlarged fragmentary view of the reducing taper lock zone of the tube of FIG. 4.
Figure 6:
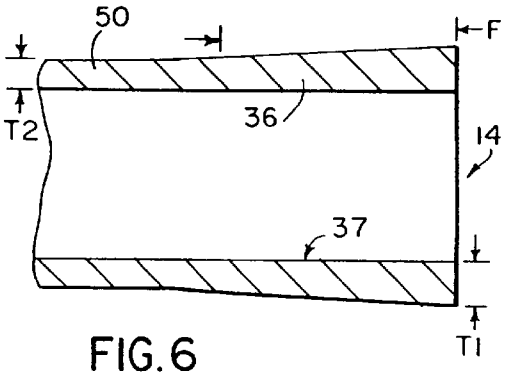
FIG. 6 is an enlarged fragmentary view of the expanding taper lock zone of the tube of FIG. 4.

The subject invention is specifically directed to improvements in the configuration of the lightweight sections to increase the overall durability and strength of both the individual lightweight sections and the overall assembled baton. In the preferred embodiment, at least the intermediate section 16 is constructed of a lightweight material such as aluminum and the outer tip section 14 is made of hardened steel. As shown in FIGS. 2–8, the intermediate section 16 is constructed from a generally cylindrical, hollow tube 50 having an initial wall thickness T1. In the preferred embodiment, the cylindrical tube 50 of FIG. 2 is swaged or otherwise cold formed to define the reducing taper 33 beginning at a first distance D1 from end surface 34, as shown in FIG. 3. As shown in FIG. 4, the formed tube 50 of FIG. 3 is then machined along its operational length L to define a finished tube having a reducing lock zone Z at reducing taper 33, an expanding lock zone F at the opposite end of tube 50 and an operational thickness T2 (also see FIG. 5). The opposite, expanding lock zone F is defined by the enlarging or flaring tapered end 36 (see FIG. 6). As shown in FIG. 6, this provides a straight walled interior wall 37 in the lock zone F, with the lock zone wall thickness increasing from thickness T2 to thickness T1 along its length. The greater wall thickness in each of the lock zones Z and F enhances the strength of the locking joint and the strength and durability of the overall baton.

Figure 8:
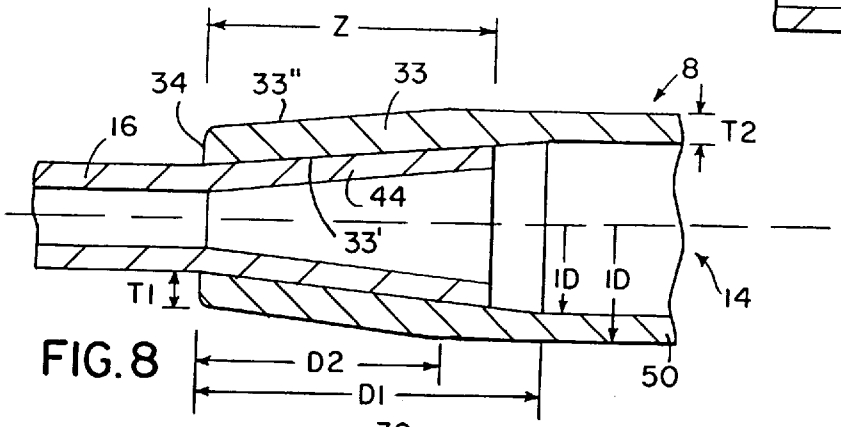
FIG. 8 is a fragmentary view looking in the same direction as FIG. 5, with the baton assembled and expanded, illustrating the lock zone for direct comparison with the lock zone of the prior art baton as shown in FIG. 7.

With reference to FIG. 8, the details of reducing taper 33 are shown. Once formed and machined, tube 50 is defined by an inner diameter ID and an outer diameter OD, the difference between the ID and the OD being operational wall thickness T2. Additionally, once tube 50 is machined, reducing taper 33 defines distinct tapered surfaces, namely inner tapered surface 33' and an outer tapered surface 33". Although inner and outer tapered surfaces 33', 33" initially began at a distance D1 from end surface 34 (see FIG. 3), the machining process of tube 50 causes the beginning of outer tapered surface 33" to shift or become offset with respect to inner tapered surface 33'. Specifically, the beginning of outer taper surface 33" is shifted closer towards the end surface 34 and as such, begins at a second distance D2 from end surface 34, wherein second distance D2 is less than first distance D1. It will be noted that the wall thickness throughout the lock zone Z is maintained at a thickness T1 or greater. Typically, the wall thickness T1 is 1.5 times the operational wall thickness T2.

Figure 1:
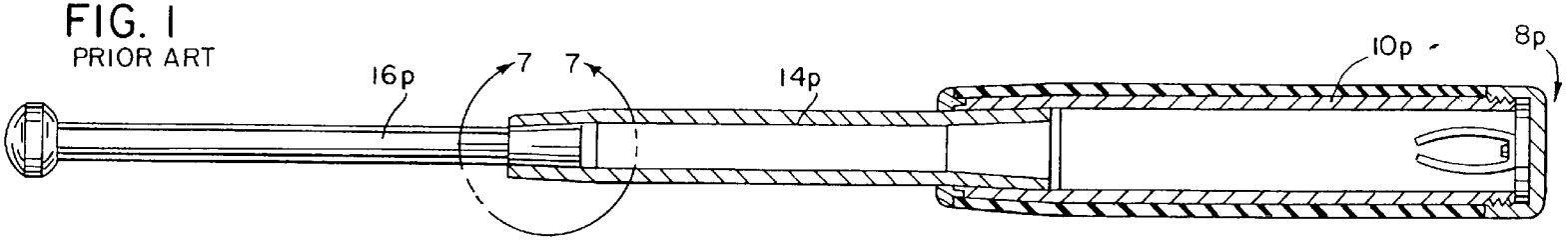
FIG. 1 PRIOR ART
FIGS. 1 and 7 are views of a prior art baton such as that disclosed in my earlier U.S. Pat. Nos. 4,752,072, 5,110,375, 5,348,297 and 5,356,139.
Figure 7:
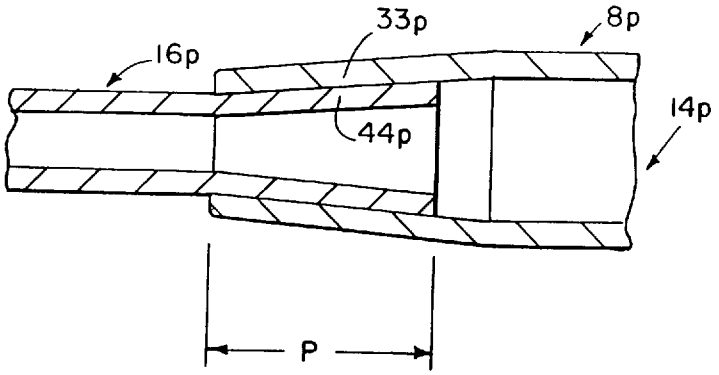
FIG. 7 PRIOR ART

It is an additional feature of the baton that the extra material provided by the thicker wall section permits a larger lock zone than that available in the prior art baton as shown in FIGS. 1 and 7. This is particularly desirable when lightweight, lower strength materials such as aluminum are used, since the enlarged zone increases the life of the baton by permitting more creep of the lock, which results from repeated use of the baton.

The prior art baton 8*p* as shown in FIG. 1 includes a handle section 10*p*, an intermediate section 14*p* and a tip section 16, corresponding to the sections 10, 14 and 16, respectively, of the subject invention. As better seen in FIG. 7, the wall section thickness of the lock zone P of the prior art baton section 14*p* is the same as the operational thickness of the cylindrical portion of the section. When compared with FIG. 8, it can be seen that the increased wall thickness of the lock zone Z results in a longer functional taper zone, wherein zone Z is of greater length than zone P of the prior art. In the preferred embodiment, zone Z is approximately 1.2 to 1.5 times longer than zone P. This increases the life of the baton by permitting more creep of the lock contact area as results from repeated use of the baton.

The various features of the embodiments of the baton may be utilized in a variety of combinations to achieve the desired weight, balance and strength for any of a variety of applications, greatly increasing the versatility of the weapon. The subject invention provides a durable, lightweight baton, wherein the various sections of the baton may be made of lightweight materials or heavy mass materials, as desired in order to meet the strike force objectives combined with the weight and balance objectives for various uses.

The baton of the subject invention provides a flexible design wherein mass considerations, strike force capability and weight issues can be addressed and met by using the proper selected combination of materials for each of the various sections 10, 14 and 16 of the baton without sacrificing function and durability, while accommodating the desire to reduce the overall weight of the equipment carried by law enforcement personnel.

While specific embodiments and features of the invention have been disclosed herein, it will be readily understood that the invention encompasses all enhancements and modifications within the scope and spirit of the following claims.

What is claimed is:

1. A method of making a baton section for an expandable baton of the type having a handle section and at least one nesting section stowable in the handle, the nesting section being of a generally cylindrical cross-section and having opposite ends defining lock zones, one lock zone of a reducing taper and the other lock zone of an increasing taper, the method comprising the steps of:

a. initially providing a cylindrical hollow tube of predetermined length and an initial predetermined wall thickness;

b. forming a reducing taper zone on one end of the tube in a swaging operation to create both an inner taper and an outer taper an said end of the tube, the reducing taper zone having a uniform predetermined wall thickness;

c. machining away excess material in a midsection zone to define a cylindrical midsection of a second predetermined thickness which is less than the initial predetermined wall thickness; and d. machining the opposite end an increasing taper the largest portion of which has a wall thickness greater than the second predetermined thickness.

2. The method of claim 1, wherein the greatest wall thickness of the increasing taper is substantially the same as the initial wall thickness.

3. The method of claim 1, wherein the wall thickness of the reducing taper is substantially constant throughout the reducing taper.

4. The method of claim 2, wherein the increasing taper includes a straight walled inner perimeter.

5. The method of claim 1, wherein the initial wall thickness is approximately 1.5 times the thickness of the second wall thickness.

6. A method for making a baton section for an expandable baton of the type having a handle section and at least one nesting section stowable in the handle, the nesting section being of a generally cylindrical cross-section and having opposite ends defining lock zones, one lock zone defined by a decreasing tapered end and the other lock zone defined by an increasing tapered end, the method comprising the steps of:

a. providing a cylindrical hollow tube having an inner surface, an outer surface, a first end with a first end surface and a second end with a second end surface;

b. forming a decreasing taper at the first end of the tube such that the tube has an inner surface taper and a first outer surface taper, the inner surface taper and the first outer surface taper each beginning at a first distance from the first end surface of the tube; and c. machining away material on the outer surface adjacent the first end of the tube until the first outer surface taper begins at a second distance from the first end surface, the second distance being less than the first distance.

7. The method of claim 6 further comprising the step of machining away material on the outer surface adjacent the second end of the tube to form a second outer surface taper.

8. The method of claim 7 wherein the step of machining away material on the outer surface adjacent the second end of the tube comprises the step of progressively increasing the amount of material removed from the outer surface of the second end as the distance from the second end surface increases.

* * * * *